US009297276B2

(12) United States Patent
Herrmann et al.

(10) Patent No.: US 9,297,276 B2
(45) Date of Patent: Mar. 29, 2016

(54) SIDE CHANNEL BLOWER, IN PARTICULAR A SECONDARY AIR BLOWER FOR AN INTERNAL COMBUSTION MACHINE

(75) Inventors: Berthold Herrmann, Neuss (DE); Rainer Peters, Goch (DE)

(73) Assignee: PIERBURG GMBH, Neuss (DE)

( * ) Notice: Subject to any disclaimer, the term of this patent is extended or adjusted under 35 U.S.C. 154(b) by 490 days.

(21) Appl. No.: 13/825,554

(22) PCT Filed: Aug. 31, 2011

(86) PCT No.: PCT/EP2011/065053

§ 371 (c)(1),
(2), (4) Date: Mar. 22, 2013

(87) PCT Pub. No.: WO2012/041625

PCT Pub. Date: Apr. 5, 2012

(65) Prior Publication Data

US 2013/0209247 A1 Aug. 15, 2013

(30) Foreign Application Priority Data

Sep. 29, 2010 (DE) ..... 10 2010 046 870

(51) Int. Cl.

| | |
|---|---|
| ***F01D 1/12*** | (2006.01) |
| ***F04D 29/44*** | (2006.01) |
| ***F01D 25/24*** | (2006.01) |
| ***F04D 23/00*** | (2006.01) |
| ***F04D 29/66*** | (2006.01) |

(52) U.S. Cl.

CPC ..... *F01D 25/24* (2013.01); *F04D 23/008* (2013.01); *F04D 29/667* (2013.01)

(58) Field of Classification Search

CPC ..... F01D 25/24; F04D 23/008; F04D 29/667
USPC ..... 415/55.1–55.7, 203–206
See application file for complete search history.

(56) References Cited

U.S. PATENT DOCUMENTS 2,245,094 A * 6/1941 Neibert ..... F04D 5/002 415/55.4
3,561,885 A * 2/1971 Lake ..... F04D 29/4226 415/204

(Continued)

FOREIGN PATENT DOCUMENTS

| | | | |
|---|---|---|---|
| CN | 1690448 | A | 11/2005 |
| DE | 100 24 741 | B4 | 7/2004 |
| DE | 10 2009 006 652 | A1 | 8/2010 |
| EP | 0 586 934 | A1 | 3/1994 |
| JP | 41-1372 | | 2/1966 |
| JP | 52 162503 | U | 12/1977 |
| JP | 56 165795 | A | 12/1981 |
| JP | 57-24493 | A | 2/1982 |
| JP | 02 099796 | A | 4/1990 |
| JP | 9-112484 | A | 5/1997 |
| JP | 2005-291149 | A | 10/2005 |
| WO | WO 2010/052044 | A1 | 5/2010 |

*Primary Examiner* — Hoang Nguyen
(74) *Attorney, Agent, or Firm* — Norman B. Thot

(57) ABSTRACT

A side channel blower includes a housing comprising a substantially tangential outlet. A housing cover comprises an axial inlet. At least one conveying duct is configured so that the axial inlet fluidly communicates with the outlet. An impeller is driven by a drive unit. The impeller is rotatably supported in the housing and comprises conveying blades which cooperate with the at least one conveying duct. An interruption region is arranged between the outlet and the axial inlet. The interruption region comprises a radially limiting wall and interrupts the at least one conveying duct in a circumferential direction. A first recess is arranged in the radially limiting wall of the interruption region downstream of the outlet. Further recesses are arranged in the interruption region before the axial inlet and after the outlet. A smallest distance between the further recesses is 0.5 to 3 times a distance between two conveying blades.

9 Claims, 2 Drawing Sheets

(56) References Cited

U.S. PATENT DOCUMENTS 3,989,411 A * 11/1976 Middleton ..... F04D 23/008 415/211.1
4,412,781 A 11/1983 Abe et al.
5,584,653 A 12/1996 Frank et al.
5,672,046 A 9/1997 Dittmar
6,336,788 B1 1/2002 Fujii et al.
8,057,168 B2 * 11/2011 Hsu ..... F04D 29/329 415/204
2005/0220614 A1 10/2005 Tsuzuki et al.
2006/0051205 A1 * 3/2006 Platz ..... F04D 29/626 415/206
2009/0136341 A1 * 5/2009 Kenyon ..... A61M 16/0057 415/203

* cited by examiner

SIDE CHANNEL BLOWER, IN PARTICULAR A SECONDARY AIR BLOWER FOR AN INTERNAL COMBUSTION MACHINE

CROSS REFERENCE TO PRIOR APPLICATIONS

This application is a U.S. National Phase application under 35 U.S.C. §371 of International Application No. PCT/EP2011/065053, filed on Aug. 31, 2011 and which claims benefit to German Patent Application No. 10 2010 046 870.3, filed on Sep. 29, 2010. The International Application was published in German on Apr. 5, 2012 as WO 2012/041625 A1 under PCT Article 21(2).

FIELD

The present invention relates to a side channel blower, in particular, to a secondary air blower for an internal combustion machine, with a housing in which a substantially tangential outlet is formed, a housing cover in which an axial inlet is formed, at least one conveying duct via which the inlet is in fluid communication with the outlet, an impeller adapted to be driven by a drive unit, the impeller being rotatably supported in the housing and comprising conveying vanes cooperating with the at least one conveying duct, and an interruption region between the outlet and the inlet, in which region the at least one conveying duct is interrupted in the circumferential direction, a first recess being formed in the radially limiting wall of the interruption region downstream of the outlet, as seen in the direction of rotation of the impeller.

BACKGROUND

Side channel blowers or pumps are generally known and have been described in a number of applications. In a motor vehicle, they serve, for example, to convey fuel or to blow in secondary air into the exhaust gas system. The drive is normally performed by an electric motor driving the impeller. At its periphery, the impeller is substantially designed such that it forms a circumferential vortex duct together with the axially opposite conveying duct. From the part of the impeller forming the vortex, duct conveying blades extend perpendicularly towards the opposite part of the conveying duct formed in the housing so that pockets are formed between the conveying blades. When the impeller rotates, the conveyed fluid in the pockets is accelerated in the circumferential direction and in the radial direction by the conveying blades so that a circulating turbulent flow is formed in the conveying duct.

Side channel blowers have been described in which only a conveying duct in an axial side of the impeller is formed in a housing part, as well as side channel blowers in which a conveying duct is formed on both axial sides of the impeller, in which case both conveying ducts are in fluid communication with each other. With such a side channel blower, one of the conveying ducts is formed in a housing part that serves as a cover, while the other conveying duct is formed in the housing part at which the drive unit is usually fastened, the impeller being arranged on the shaft thereof at least such that it rotates therewith.

In order to obtain as good a conveyance or pressure increase as possible, it is necessary to use as large a part of the circumference of the conveying duct as possible. For this reason, the inlet and the outlet must be spaced as far as possible from each other along the circumference, as seen in the direction of rotation of the impeller, where a short-circuit flow between the inlet and the outlet must be prevented by an interruption region. Such side channel blowers have been found problematic with respect to a high noise development which is caused, in particular, by pulsations that occur due to sudden pressure pulses of the air conveyed.

These pressure pulses occur, among other instances, immediately after the sweeping of each of the conveying blades at the beginning of the interruption region since the pockets between the conveying blades still hold compressed air that has not been expelled completely through the outlet, which air is suddenly accelerated against the walls thereof when the interruption portion is reached. This results in significantly increased noise emissions.

For a reduction of these noise emissions, DE 10 2008 24 741 B4 describes a side channel blower for feeding secondary air in which a housing cover of the housing is formed with a recess upstream of the inlet, as seen in the direction of impeller rotation, the recess becoming constantly larger towards the inlet and having a width that substantially corresponds to the width of the conveying duct.

A side channel blower is also described in DE 10 2009 006 652 A1 which also comprises a housing part with a conveying duct and a housing cover with a second conveying duct formed on the side of the first conveying duct opposite the impeller. The radially limiting wall of the interruption region between the inlet and the outlet has an additional recess formed therein downstream of the outlet, as seen in the direction of impeller rotation.

Both measures may result in a significant noise reduction, however, undesirable noise emissions remain when conveying against a closed control valve, i.e., at maximum counterpressure in the conveying chambers.

SUMMARY

An aspect of the present invention is to provide a side channel blower with which noise can be significantly reduced also when the valve is closed.

In an embodiment, the present invention provides a side channel blower which includes a housing comprising an outlet, the outlet being configured to be substantially tangential. A housing cover comprises an axial inlet. At least one conveying duct is configured so that the axial inlet is in a fluid communication with the outlet. An impeller is configured to be driven by a drive unit. The impeller is rotatably supported in the housing and comprises conveying blades. The conveying blades are configured to cooperate with the at least one conveying duct. An interruption region is arranged between the outlet and the axial inlet. The interruption region comprises a radially limiting wall and is configured to interrupt the at least one conveying duct in a circumferential direction. A first recess is arranged in the radially limiting wall of the interruption region downstream of the outlet, as seen in a direction of rotation of the impeller. Further recesses are arranged in the interruption region before the axial inlet and after the outlet. A smallest distance between the further recesses is 0.5 to 3 times a distance between two of the conveying blades. This results in significantly reduced noise emissions when the control valve is closed, i.e., when the pump conveys against a closed valve, without resulting in pressure losses or delivery rate losses in the open state of the valve.

BRIEF DESCRIPTION OF THE DRAWINGS

The present invention is described in greater detail below on the basis of embodiments and of the drawings in which.

DETAILED DESCRIPTION

Figure 1:
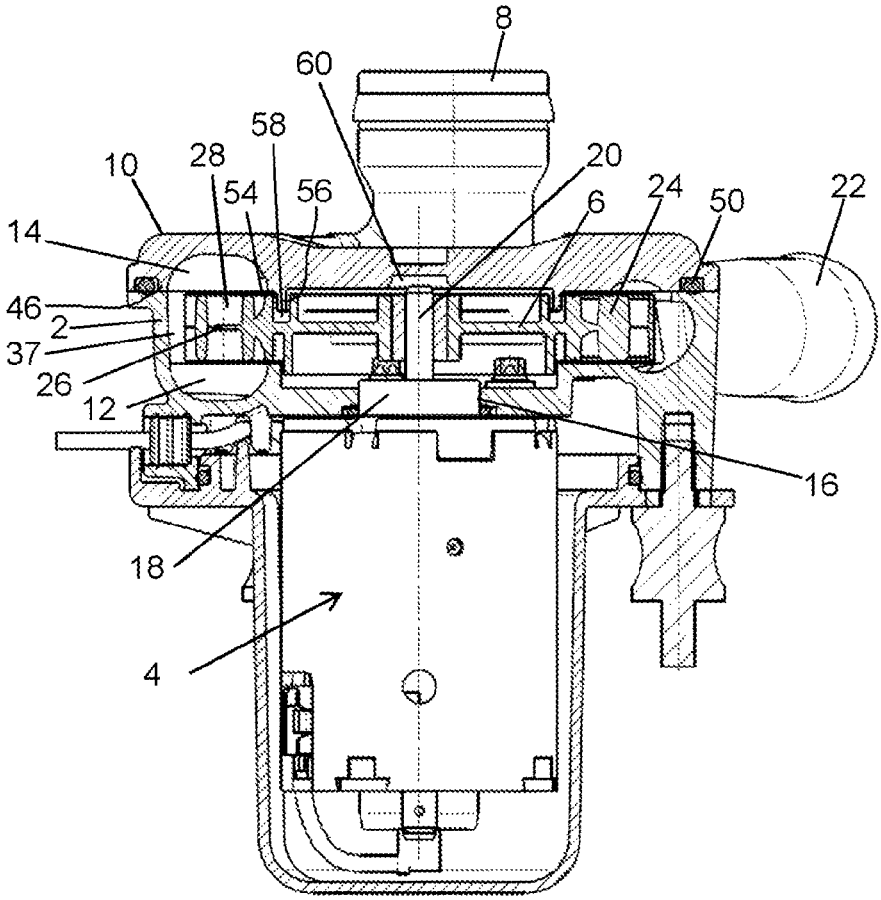
FIG. 1 shows a side elevational view of a side channel blower according to the present invention, showing the same in section.

In an embodiment of the present invention, particularly low emission values at almost unchanged maximum pressure are achieved when the smallest distance between the recesses before the inlet and after the outlet is 1.5 times the distance between two conveying blades.

In the interest of also minimizing noise in the open state of the valve, it has been found to be advantageous if the first recess in the radially limiting wall of the interruption region is adjoined by a second recess, as seen in the direction of impeller rotation, the depth thereof being inferior to that of the first recess.

In an embodiment of the present invention, the second recess extends over the height of the conveying duct, partly formed in the housing cover, and in the radially limiting wall of the interruption region, the height of the second recess decreasing constantly towards the inlet. A constant pressure reduction is thus achieved so that pressure peaks are prevented.

In an embodiment of the present invention, the recess formed upstream of the inlet at the interruption region, as seen in the direction of impeller rotation, can, for example, be in fluid communication with the inlet, the depth of the recess increasing continuously from the upper edge of the interruption region facing the impeller to the inlet. This also helps to realize a continuous relaxation of the air.

In an embodiment of the present invention, the width of the recess before the inlet substantially corresponds to the radial dimension of the conveying blades, whereby undesirable vortices at the inlet are avoided.

In an embodiment of the present invention, the depth of the recess can, for example, continuously increase radially outward up to a limiting edge of the recess so that in regions of higher velocities a larger relaxation cross section is available for the air.

Particularly good results are achieved when the limiting edge of the recess before the inlet has a first region where the width of the recess substantially corresponds to the radial dimension of the conveying blades, and has a contiguous second region angled radially inward towards the first region, as seen in the direction of impeller rotation.

A side channel blower is thus provided wherein, in comparison with known side channel blowers, noise emissions are particularly low especially in the closed state of the control valve, i.e., in a state of zero delivery of the pump against a closed valve, while at the same time the maximum possible delivery rate remains largely unchanged.

An embodiment of a side channel blower according to the present invention is illustrated in the drawings and will hereinafter be explained.

The side channel blower illustrated in FIG. 1 is formed by a housing 2 as well as by an impeller 6 serving, for example, to convey air, the impeller being rotatably supported in the housing 2 and being driven by a drive unit 4. The air reaches the interior of the side channel blower through an inlet 8 formed in a housing cover 10.

From the inlet 8, the air flows into two substantially annular conveying ducts 12, 14, with the first conveying duct 12 being formed in the housing 2, in whose central opening 16 a bearing 18 of a drive shaft 20 of the drive unit 4 is arranged, on which the impeller 6 is fastened, and the second conveying duct 14 being formed in the housing cover 10. The air escapes through a tangential outlet 22 arranged in the housing 2.

The impeller 6 is arranged between the housing cover 10 and the housing 2 and comprises conveying blades 24 along its periphery that are of a curved design, with the overall extension, i.e., a connection between the base region and the radially outer end region, being directed substantially radially toward the center of the impeller. The conveying blades 24 are divided by a radially extending circumferential ring 26 into a first row axially opposite the first conveying duct 12 and a second row axially opposite the second conveying duct 14, so that two vortex ducts are provided that are respectively formed by one of the conveying ducts 12, 14 and the part of the impeller 6 facing the same. The outer diameter of the conveying ducts 12, 14 is slightly larger than the outer diameter of the impeller 6 so that fluid communication between both conveying ducts 12, 14 exists outside the outer circumference of the impeller 6 such that an exchange of air can take place between the two conveying ducts 12, 14. Pockets 28 that open radially outward are thus formed between the conveying blades 24 extending from the circumferential ring 26, in which pockets air is conveyed or accelerated so that the pressure thereof is increased along the length of the conveying ducts 12, 14.

In order to achieve as good a delivery rate and a pressure increase as possible, the axial inlet 8 is arranged as far as possible from the tangential outlet 22, as seen in the direction of rotation of the impeller 6. In order to reliably prevent a short-circuit flow against the rotational direction of the impeller 6 from the inlet 8 to the outlet 22, interruption regions 30, 32 are provided at the housing cover 10 and the housing 2 between the inlet 8 and the outlet 22, which interruption regions 30, 32 interrupt the conveying ducts 12, 14 so that the smallest possible gap exists in the interruption regions 30, 32 axially opposite the conveying blades 24 of the impeller 6. In addition, an interruption region 34, effective in the radial direction, is formed in a radially limiting wall 36 of the housing 2, which region interrupts a radially outer connecting region 37 between the two conveying ducts 12, 14.

Figure 2:
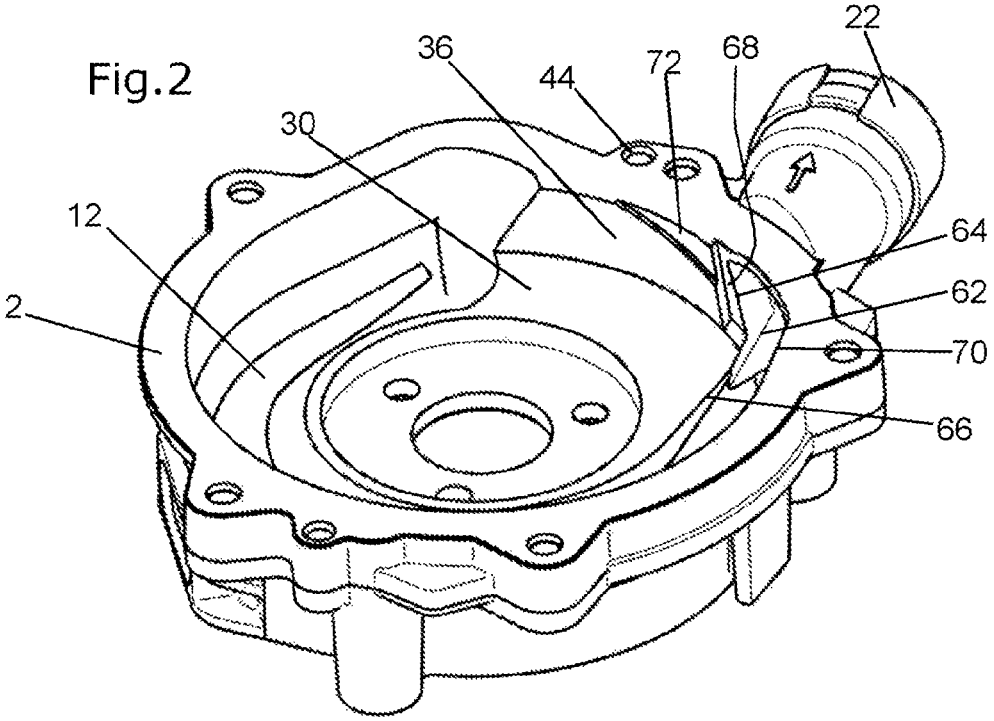
FIG. 2 shows a perspective illustration of the housing of the side channel blower of FIG. 1.
Figure 3:
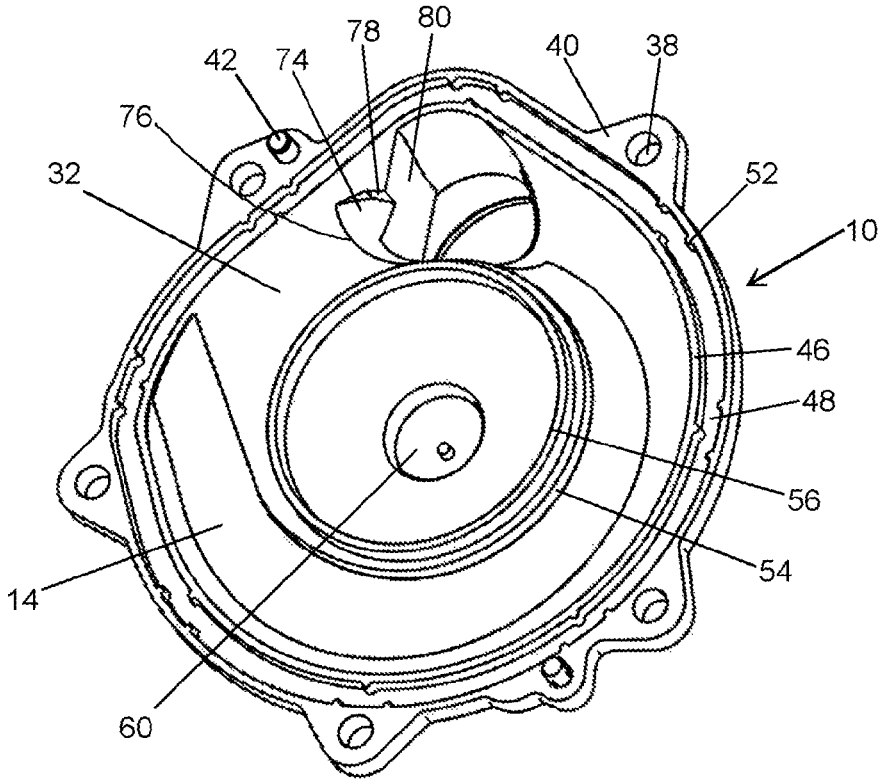
FIG. 3 shows a perspective illustration of the housing cover of the side channel blower of FIG. 1.
Figure 4:
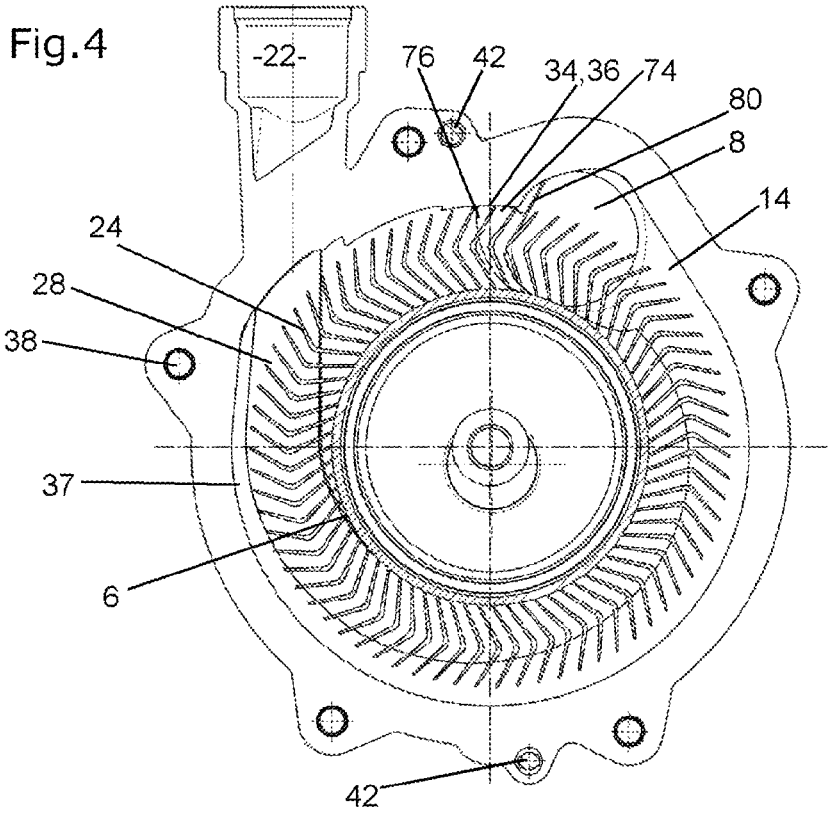
FIG. 4 shows a top plan view on the housing cover, the housing being illustrated in section.

FIGS. 2 and 3 show that the conveying ducts 12, 14 provided in the housing 2 and the housing cover 10 have a substantially constant width and extend along the circumference of the housing cover 10 and the housing 2, except for the interruption regions 30, 32. According to the view chosen in FIG. 2, the impeller 6 thus rotates counterclockwise from the beginning of the conveying duct 12 to the end of the conveying duct 12 or to the outlet 22, respectively, and thereafter rotates back, via the interruption region 30, to the beginning of the conveying duct 12 opposite the inlet 8, whereas in FIG. 3 the impeller 6 is rotated clockwise, i.e., from the inlet 8 back to the inlet 8 via the second conveying duct 14 and the interruption region 32.

The housing cover 10 in FIG. 3 is fastened to the housing by means of screws which are passed through corresponding bores 38 formed in radially outward directed projections 40 at the housing cover 10. Two of these projections 40 are additionally provided with small axially extending bolts 42 that serve to preliminarily fix the housing cover 10 on the housing 2 which is formed with corresponding bores 44 shown in FIG. 2.

A groove 48 is formed radially behind a wall 46 of the second conveyor duct 14, into which a sealing ring 50 is placed to provide for a sealing between the housing cover 10 and the housing, the ring being retained in the groove 48 by noses 52.

An annular rib 56 is formed radially in front of a wall 54 of the second conveying duct 14, which in the assembled state of the blower engages in a corresponding groove 58 of the impeller 6, whereby a sealing is achieved from the second conveying duct 14 towards the interior of the impeller 6. In addition, the housing cover 10 has a cylindrical recess 60 into which the drive shaft 20 of the drive unit 4 protrudes.

The conveying ducts 12, 14 in the housing cover 10 and in the housing 2 are shaped such that, in the region before the outlet 22, they extend towards the outlet 22, i.e., in a tangential direction instead of a circumferential direction in which they extended before. The width of the conveying ducts 12, 14 is smaller than the width of the outlet 22 so that the flow from the conveying ducts 12, 14 is first directed to the outlet via its radially outer region. An outlet opening 62 leading through the radially limiting wall 36 of the housing 2 and connecting the interior of the blower with the outlet 22 is shaped such that, as seen in the rotational direction of the impeller 6, the outlet opening 62 extends into the interruption regions 30, 32 of the housing parts 2, 10, as can be seen in FIG. 2.

In the embodiment illustrated herein, an outlet edge 64 delimiting the outlet opening 62 in the rotational direction of the impeller 6 extends from an inner edge 66 of the first conveying duct 12 in the housing 2 obliquely upward along the radially limiting wall 36, i.e., with an axial component in the direction of the housing cover 10 and a component in the rotational direction of the impeller 6. The angle of this bevel should be chosen such that, over the height of the outlet opening 62, the component in the circumferential direction corresponds at least to the distance between two conveying blades 24.

In addition to this particular design of the outlet opening 62, a first recess 68 is formed at the interruption region 34 of the radially limiting wall 36 at a position immediately after the outlet opening 62. In the rotational direction of the impeller 6, this first recess 68 is delimited by an interrupting edge 70 which also extends obliquely upward from the bottom of the housing 2, i.e., which has an axial component in the direction of the housing cover 10 and a component in the rotational direction of the impeller 6. The interrupting edge 70 and the outlet edge 64 do not, however, extend in parallel, but are arranged under an angle with respect to each other, the component in the rotational direction being larger for the outlet edge 64 than for the interrupting edge 70. It should be noted that for a larger distance between the conveying blades 24 of the impeller 6, the included angle between the interrupting edge 70 and the outlet edge 64 should be chosen to be larger as well.

The first recess 68 is also adjoined by a second recess 72, as seen in the rotational direction of the impeller 6, whose depth of about 1 mm is less than that of the first recess 68. The second recess 72 extends obliquely upward from the interrupting edge 70 from about half the height of the radially limited wall 36 towards the housing cover 10. The starting point of this second recess 72 is thus situated at about the level of the circumferential ring 26 of the impeller 6 so that it is formed in the region of the vortex duct to which the second conveying duct 14 in the housing cover 10 belongs. Due to the inclined shape, the second recess 72 becomes continuously smaller towards the inlet 8 and has a circumferential length that corresponds to about five (5) times the distance between two conveying blades 24.

Looking at the movement of an individual pocket 28 in the region of the outlet 22, which pocket faces to the housing cover 10 and which, due to the arrangement of the inlet 8, is filled to a higher level than the opposite pocket 28, the former first sweeps the interruption region 32 of the housing cover 10 with its radially inner edge. As the impeller 6 rotates further, the pocket 28 is covered from the inside to the outside by the interruption region 32 so that only a significantly reduced portion of the air can flow back into the pocket 28. Before the pocket 28 is fully covered by the interruption region 32, the pocket 28 reaches the outlet opening 62 so that the compressed air can escape. When the end of the second conveying duct 14 is reached, however, there still is compressed air in the pocket 28 of the impeller 6, which escapes from the pocket 28 at its radial outer edge. The velocity vector of this residual air has a radially outward directed component, a component in the rotational direction of the impeller 6, as well as a component directed towards the housing cover 10. The component of the air flow in the circumferential direction substantially here corresponds to the velocity component of the impeller 6. As a consequence, due to the selected maximum extension of the outlet opening 62 in the rotational direction, the air flowing from the pocket 28 does not impinge on the outlet edge 64 of the outlet opening 62 in the form of a pressure pulse, but simply flows into the outlet 22.

The air flowing out behind the outlet opening 62 also does not immediately impinge on the interruption region 34 of the radially limiting wall 36, but flows into the first recess 68, where at least a slight relaxation occurs by a swirling of the air reaching the first recess 68. The angle is chosen such that neither the air flow ejected simultaneously over the entire height of the pocket 28, nor the air flow ejected simultaneously over the entire width reaches the interrupting edge 70 at the same time. Concurrently, the relaxation path for the existing residual air becomes larger. This allows for an additional reduction of pressure pulses.

With the control valve closed, however, pressure pulsations are still generated in the region of the outlet 22 that cause undesirable noise up to the inlet 8, if the second recess 72 is not additionally provided. Due to this second recess 72, the pulsations, increased by the fact that the outlet 22 is closed, are reduced by additional vortex formation in the region of the second recess 72. The air flowing radially outward is given additional outflow cross sections that provide a reduction of pressure peaks without resulting, in the open state of the valve, in a pressure loss due to overflows towards the inlet 8.

Upstream of the inlet 8, as seen in the rotational direction of the impeller 6, a further recess 74 is formed which extends from an upper edge of the interruption region 32 towards the inlet 8. The further recess 74 is shaped such that its depth constantly increases towards the inlet 8 and also radially outward, approximately up to a depth that corresponds to the depth of the second conveying duct 14. In a first region, the width of the further recess 74 initially corresponds approximately to the width of the second conveying duct 14 or the radial extension of the conveying blades 24, respectively, the radial limiting edge 78 of the further recess 74 being angled radially inward, as seen in the rotational direction of the impeller 6, in a region just before the inlet 8, so that the width slowly decreases. The further recess 74 extends for a length that is about 2.5 times the distance between two successive conveying blades 24 of the impeller 6.

In order to increase the delivery volume, the inlet 8 has a diameter larger than the width of the second conveying duct 14, an inner edge of the inlet 8 being arranged on the same radius as an inner edge of the second conveying duct 14, so that the cover element 10 has a greater circumference at the inlet 8 than in the other regions. In addition, a front edge 76, forming the boundary line between the interruption region 32 and the further recess 74, is shaped arcuately so that the conveying blades 24 of the impeller 6 sweep over the further recess 74 first in the radially outer region and thereafter in the radially inner region. On the side directed to the further recess 74, the inlet is delimited by a straight wall 80 that is arranged such with respect to the conveying blades 24 that an angle of 10-20° is formed between the straight wall 80 and the outward directed end of the conveying blades 24. The radially outer part of each conveying blade 24 thus sweeps over the inlet 8 first.

The compressed air remaining in the pockets 28 downstream of the outlet 22, which is guided through the interruption region 32, is slowly relaxed as the further recess 74 is reached and the available space becomes ever larger, a complete relaxation occurring as the inlet 8 is reached. The respective additional available space flares from the inside to the outside, i.e., starting from the region of the highest air velocity and compression.

The actual interruption region, i.e., the distance between the rear end of the second recess 72, as seen in the direction of rotation, and the front end of the front edge 76 of the further recess 74, is about 1.5 times the distance between two conveying blades 24 of the impeller 6. Especially in the closed state of the outlet valve, such a configuration can reduce pressure peaks that lead to undesirable noises, however, without resulting in an excessive delivery pressure loss in the open state of the valve. Instead, very good results can be achieved in the closed state of the valve, both with respect to emissions and to the obtainable pressures.

The side channel blower described is thus characterized by a significant reduction of noise emissions as compared to known side channel blowers. At the same time, a high delivery rate is achieved.

It should be clear that various modifications can be made to the side channel blower described in connection with the embodiment. In particular, it may be a pump with only a single side channel or the inlet and the outlet may be configured in a modified manner.

The present invention is not limited to embodiments described herein; reference should be had to the appended claims.

What is claimed is:

1. A side channel blower comprising:

a housing comprising an outlet, the outlet being configured to be substantially tangential;

a housing cover comprising an axial inlet;

at least one conveying duct which is configured so that the axial inlet is in a fluid communication with the outlet;

a drive unit;

an impeller which is configured to be driven by the drive unit, the impeller being rotatably supported in the housing and comprising conveying blades, the conveying blades being configured to cooperate with the at least one conveying duct;

an interruption region arranged between the outlet and the axial inlet, the interruption region comprising a radially limiting wall and being configured to interrupt the at least one conveying duct in a circumferential direction;

a first recess arranged in the radially limiting wall of the interruption region downstream of the outlet, as seen in a direction of rotation of the impeller; and further recesses arranged in the interruption region before the axial inlet and after the outlet, a smallest distance between the further recesses being 0.5 to 3 times a distance between two of the conveying blades.

2. The side channel blower as recited in claim 1, wherein the smallest distance between the further recesses before the axial inlet and after the outlet is 1.5 times the distance between two of the conveying blades.

3. The side channel blower as recited in claim 1, wherein the further recesses comprise a second recess which, as seen from the direction of rotation of the impeller, adjoins the first recess in the radially limiting wall of the interruption region, and a depth of the second recess is less than a depth of the first recess.

4. The side channel blower as recited in claim 3, wherein the at least one conveying duct is arranged in part in the housing cover, the second recess is configured to extend in the radially limiting wall of the interruption region over a height of the at least one conveying duct, and a height of the second recess constantly decreases in a direction of the axial inlet.

5. The side channel blower as recited in claim 1, wherein the further recesses comprise a third recess arranged upstream of the axial inlet at the interruption region, as seen in the direction of rotation of the impeller, and the interruption region further comprises an upper edge, wherein the third recess is in a fluid communication with the axial inlet, and a depth of the third recess constantly increases from the upper edge of the interruption region facing the impeller to the axial inlet.

6. The side channel blower as recited in claim 5, wherein a width of the third recess before the axial inlet substantially corresponds to a radial extension of the conveying blades.

7. The side channel blower as recited in claim 5, wherein the third recess further comprises a limiting edge, and a depth of the third recess constantly increases radially outward up to the limiting edge of the third recess.

8. The side channel blower as recited in claim 7, wherein the limiting edge of the third recess comprises a first portion arranged before the axial inlet in which a width of the third recess substantially corresponds to the radial extension of the conveying blades, and an adjoining second portion which is angled radially inward with respect to the first portion, as seen from the direction of rotation of the impeller.

9. The side channel blower as recited in claim 1, wherein the side channel blower is provided as a secondary air blower for an internal combustion machine.

* * * * *